United States Patent [19]

Belsky et al.

[11] 4,349,418

[45] Sep. 14, 1982

[54] PRODUCTION OF METHYLNAPHTHALENES AND TAR BASES INCLUDING INDOLE

[75] Inventors: Stephen E. Belsky, Parsippany; Chempolil T. Mathew, Randolph, both of N.J.

[73] Assignee: Allied Corporation, Morris Township, Morris County, N.J.

[21] Appl. No.: 287,668

[22] Filed: Jul. 28, 1981

[51] Int. Cl.[3] ..... G01D 3/14; G01D 11/04

[52] U.S. Cl. ..... 203/45; 203/46; 208/42; 208/45; 546/353

[58] Field of Search ..... 203/39, 43–46, 203/33, 36, 37, 51; 208/42, 41, 45; 546/134, 139, 152, 353

[56] References Cited

U.S. PATENT DOCUMENTS

| | | | |
|---|---|---|---|
| 2,113,951 | 4/1938 | Shuman | 546/353 |
| 2,456,774 | 12/1948 | Engel | 260/283 |
| 3,412,168 | 11/1968 | Masciantonio | 260/674 |
| 3,490,586 | 1/1970 | Jaisle et al. | 208/45 |

OTHER PUBLICATIONS

R. E. Kirk and D. F. Othmer, "Quinoline and Isoquinoline" in the Encyclopedia of Chemical Technology, 1947–1960, vol. 11, p. 391.

Chemical Abstracts 45: 8741c, (1951), H. G. Franck.

Chemical Abstracts 54: 539i, (1959), N. D. Rus'yanova et al.

Chemical Abstracts 55: 14878i, (1960), N. D. Rus-'yanova et al.

Chemical Abstracts 87: 87495h, (1976), Zaretskii et al.

Chemical Abstracts 61: 9332a, (1964), Gundermann.

J. F. Weiler, "High Temperature Tar" in H. H. Lowry. "Chemistry of Coal Utilization," pp. 621–625, esp. 625, (1963).

*Primary Examiner*—Frank Sever

*Attorney, Agent, or Firm*—Alan M. Doernberg; Gerhard H. Fuchs

[57] ABSTRACT

Methylnaphthalenes, indole and other tar bases are recovered from a base-extracted coal tar distillation fraction. In one form, an aqueous salt solution of pH 0.5–3 extracts other tar bases from the starting material, and thereafter both products are recovered from the raffinate by several alternate methods including ethylene glycol extraction and extractive distillation. In other forms, the starting material is extracted with ethylene glycol and the extract is distilled to recover several products including indole. The raffinate of ethylene glycol extraction contains methylnaphthalenes and other hydrocarbons and can be purified to solvent-grade material.

18 Claims, 3 Drawing Figures

PRODUCTION OF METHYLNAPHTHALENES AND TAR BASES INCLUDING INDOLE

DESCRIPTION

BACKGROUND OF THE INVENTION

It has been conventional to distill coal tar and produce a fraction of intermediate boiling point (180°–300° C.) and extract from this fraction so-called tar acids, primarily phenols and cresols and some xylenols with aqueous base such as aqueous sodium hydroxide. The raffinate from such extraction contains naphthalene, methylnaphthalene isomers, biphenyl and a variety of nitrogen containing compounds which are collectively referred to as tar bases. Various references describe the extraction of this raffinate (usually after distillation to remove naphthalene and lower boilers and also some higher boilers) with weak acid such as 20% sulfuric acid to produce an organic raffinate containing methylnaphthalene and an aqueous extract which, upon neutralization, forms an organic layer containing the tar bases. Examples of such processes are described in U.S. Pat. No. 2,456,774 to Engel (1948) and page 391 of Kirk & Othmer, Encyclopedia of Chemical Technology, Vol. 11 (1st Edition 1953). U.S. Pat. No. 3,412,168 to Masciantonio (1968) discloses a process of liquid phase extractions with sulfuric acid, caustic solution and water, followed by distillation. It appears that tar acids remain in the material of U.S. Pat. No. 3,412,168 in a significant quantity until the caustic solution extraction.

Indole is a valuable chemical used, for example, in the production of tryptophan and in fragrances. While various reports have been made of the identification of indole in coal tar, an economical process for recovering such indole has not been developed. Specifically, the above processes involving extraction with acid do not produce indole as a significant component in the tar base organic layer generated by neutralization. Instead it generally polymerizes and must be disposed of as a gummy waste material.

BRIEF DESCRIPTION OF THE INVENTION

The present invention includes a process for the recovery of tar bases and color-stable methylnaphthalene solutions from a base-extracted tar distillation fraction which comprises the steps:

(a) extracting a base-extracted tar distillation fraction containing methylnaphthalenes, indole and a member selected from the groups consisting of quinoline, isoquinoline and mixtures thereof with a buffered aqueous salt solution having a pH between about 0.5 and about 3.0 to produce an aqueous extract containing quinoline, isoquinoline or both and a raffinate containing methylnaphthalenes and indole and substantially free of quinoline and isoquinoline, (b) recovering indole from said raffinate to produce a color-stable methylnaphthalene solution, and (c) recovering quinoline, isoquinoline or mixtures thereof from said aqueous extract.

The present invention also includes a method for separating a mixture comprising methylnaphthalenes and indole which comprises extracting said mixture with ethylene glycol and recovering a raffinate comprising methylnaphthalene and an extract comprising indole and ethylene glycol. Such method of separating methylnaphthalenes from indole is particularly applicable to step (b) of the process first described above.

DETAILED DESCRIPTION OF THE INVENTION

Figure 1:
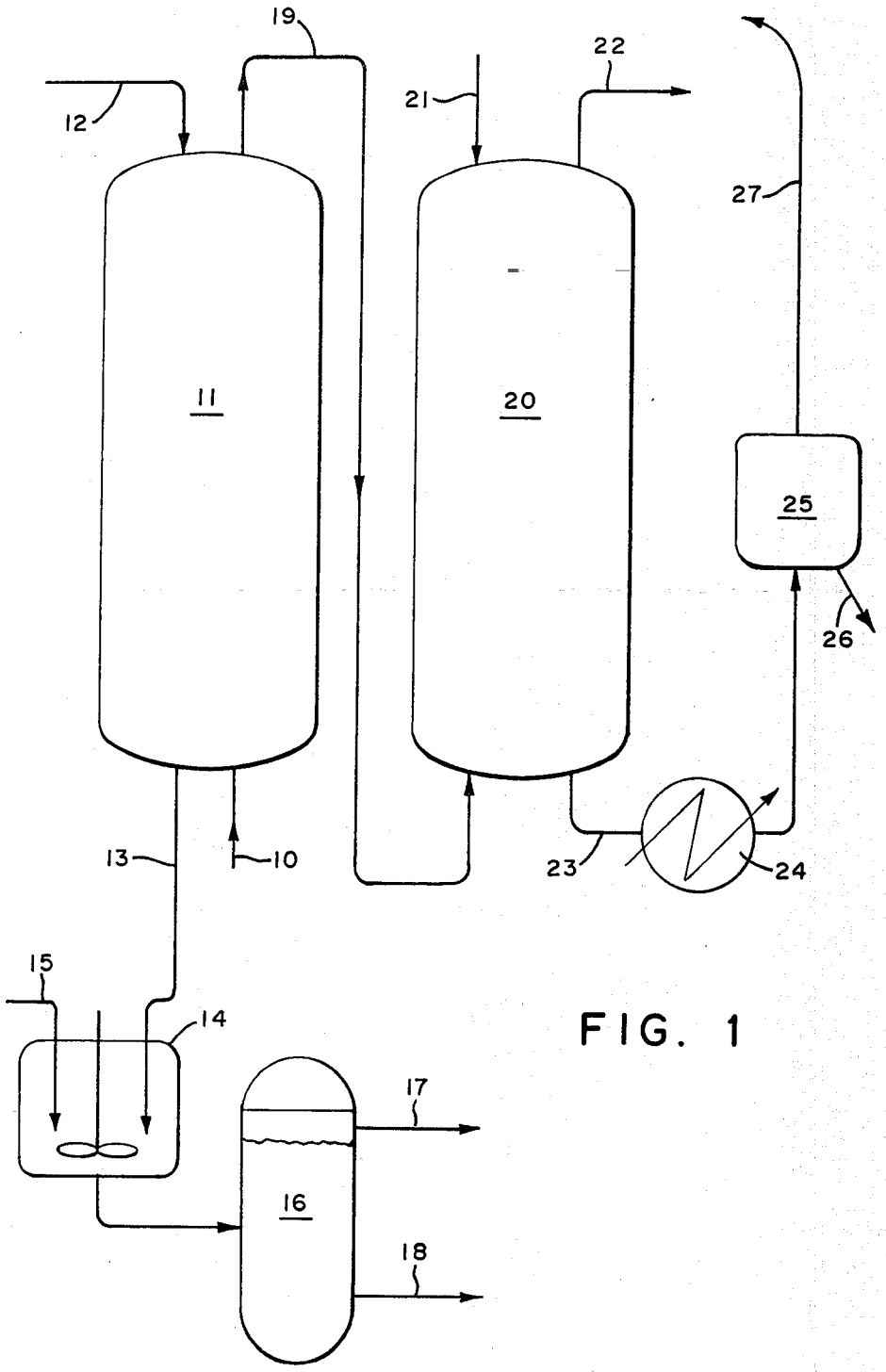

The tar distillation fraction to which the present process applies may have a boiling point in the general range of about 215° C. to about 300° C., preferably about 230° C. to about 300° C. One especially preferred fraction has boiling points in the range of about 230° C. to about 275° C. and is especially useful to produce solvent grade methylnaphthalene. It should be extracted with base to a degree sufficient to remove tar acids, and especially phenolics and cresols to a level below about 0.5%. It is contemplated that a tar distillation fraction having different boiling point ranges than described above may be first recovered, subsequently extracted with base to remove tar acids and thereaafter further distilled to produce a tar fraction with a desirable boiling point range. Naphthalene may be recovered as a separate product during the second distillation.

In the process of the invention, such a base-extracted tar distillation fraction, which will contain methylnaphthalenes, indole, generally both quinoline and isoquinoline, and frequently other materials such as diphenyl, acenaphthene, dibenzofuran, fluorene, naphthalene, thianaphthene and other similarly boiling hydrocarbons, oxyhydrocarbons and thiohydrocarbons, is extracted with an aqueous salt solution having a pH between about 0.5 and about 3.0 such as aqueous ammonium bisulfate or aqueous sodium bisulfate. Other suitable salt solutions include potassium bisulfate, sodium dihydrogen phosphate-phosphoric acid mixtures and ammonium dihydrogen phosphate-phosphoric acid mixture. As indicated in Example 3, below, salt solutions having pH values below about 0.5 remove indole in addition to the other tar bases, while salt solutions having pH values above about 3.0 leave quinoline and/or isoquinoline along with indole in the organic raffinate. Inorganic acid solutions (e.g. aqueous sulfuric acid alone) suffer from difficulties in control, requiring rather exact control of ratios between acids and tar bases to avoid removing indole or leaving quinoline and/or isoquinoline in the organic raffinate. With the aqueous salt solution of the desired pH, exact control of mixing ratios is not required, with any amount in excess of stoichiometry to remove the desired quinoline and/or isoquinoline being satisfactory.

This extraction may be conducted in a cocurrent or countercurrent fashion, either in a number of a distinct stages or in an extraction column or the like.

The aqueous extract produced and separated contains quinoline and/or isoquinoline as acid addition salts together with the acidic salt in water. Neutralization with base converts the tar base back to base form, and therefore causes an organic layer rich in quinoline and/or isoquinoline to form. Those materials may then be separated one from another in conventional fashion if desired.

The raffinate containing methylnaphthalenes and indole may be further treated in several fashions to recover each component in usable form. One alternative is to extract the raffinate with phosphoric acid to remove the indole as a phosphoric acid addition salt into the aqueous layer, leaving base-free methylnaphthalene mixed only with hydrocarbons and the like. The extract can then be neutralized with base to recover the indole as an organic layer.

A second method of recovering indole is to extractively distill in the presence of ethylene glycol to produce a first overhead comprising methylnaphthalenes and a second overhead comprising indole and ethylene glycol. Either batch distillation (with overheads recovered sequentially) or continuous distillation (with overheads recovered separately on a continuous basis from the same or different columns) may be employed. Frequently, other materials are present in the base-extracted tar distillation fraction subjected to the present process: e.g. biphenyl, acenaphthene, dibenzofuran or mixtures thereof. Such components will remain in the raffinate of aqueous salt extraction, and will therefore be present during extractive distillation with ethylene glycol. Since they will come over after methylnaphthlenes, but before indole-ethylene glycol, they can be recovered with either, or recovered separately as an intermediate product, if desired. Furthermore, in recovering the methylnaphthalenes, it is possible to separately recover an initial overhead fraction rich in 2-methylnaphthalene, and then a subsequent overhead fraction rich in 1-methylnaphthalene, both compared to the isomer distribution in both the base-extracted tar distillation fraction and the organic raffinate from the aqueous salt extraction.

The third, and preferred, means of recovering indole from the raffinate of salt extraction in the process of the invention is extraction with ethylene glycol. This represents, as well, the first step of the method of the invention. In this step, a mixture comprising methylnaphthalenes and indole, such as the raffinate from salt extraction, is extracted with ethylene glycol in an amount sufficient to remove the indole, preferably to level below 1000 ppm. In the present process, other polyhydric alcohols such as propylene glycol, polyethylene glycols and the like may also be used, but ethylene glycol is preferred. Once the extract containing ethylene glycol and indole is formed, it may be separated by distillation, by distillation followed by crystallization of indole from ethylene glycol or by crystallization alone. Crystallization alone is preferred if the indole concentration in ethylene glycol exceeds 35 weight percent; distillation followed by crystallization is preferred if the indole concentration in ethylene glycol is less than about 35 weight percent.

The method of the invention can also be applied to the starting base-extracted tar distillation fraction where biphenyl and acenaphthene are present and will segregate in the methylnaphthalene phase, while quinoline, isoquinoline and indole will segregate in the ethylene glycol phase. In such case, the methylnaphthalenes may either be used in admixture with acenaphthene and biphenyl (and sometimes other hydrocarbons) for solvent applications, or may be distilled in pure form from the raffinate. The extract containing indole, quinoline and isoquinoline in ethylene glycol can be distilled as illustrated in Example 1 to produce a quinoline, isoquinoline, ethylene glycol mixture as a first overhead, ethylene glycol as a second overhead and indole-rich fraction as a third overhead. Crystallization of indole from the third overhead will then produce product indole and ethylene glycol which, together with the second overhead, may be recycled to the initial extraction. If quinoline and/or isoquinoline are recovered from the first overhead (e.g. by steam stripping or by extraction with a solvent such a toluene) the ethylene glycol produced may also be recycled.

FIG. 1 illustrates one embodiment of the process of the present invention employing aqueous base extraction followed by ethylene glycol extraction.

A coal tar distillation fraction, having been extracted with base to remove tar acids, is fed in stream 10 to the base of an extraction column 11. An aqueous salt solution such as 2.5 molar ammonium bisulfate is fed in stream 12 to the top of the extraction column. The aqueous phase, which is heavier, is removed as stream 13 from the base of the column and fed to mixer 14 where it is combined with a stoichiometric amount of base, such as ammonia, fed in stream 15. The neutralized extract is then fed to a separation vessel 16 wherein a small organic layer containing quinoline and isoquinoline forms on the top of the aqueous ammonium sulfate. The quinoline and isoquinoline are removed in stream 17 for further purification, and the ammonium sulfate solution is removed in stream 18. A portion of stream 18 can be converted with sulfuric acid to ammonium bisulfate for return to stream 12. The remainder can be crystallized to recover solid ammonium sulfate useful as a fertilizer.

The raffinate from extraction column 11 is removed at the top in stream 19 and fed to the base of a second extraction column 20. Ethylene glycol is fed in stream 21 to the top of second extraction column 20. After countercurrent extraction, a raffinate is removed in stream 22 and will contain methylnaphthalenes, together with various hydrocarbons which were initially present in stream 10; but stream 22 will be essentially free of tar bases, both quinoline and isoquinoline which were extracted into stream 13 and indole which was extracted into the ethylene glycol in second extraction column 20. The extract is removed from the base of second extraction column 20 in stream 23 and chilled in crystallizer 24 to form a slurry of indole in ethylene glycol. In a conventional separation vessel 25, such as a centrifuge or filter, the solid indole is removed as shown by stream 26 and the remaining mother liquor 27 is also removed. The mother liquor may be distilled or otherwise treated to remove the bulk of the ethylene glycol for return to stream 21, with the remainder of the mother liquor recycled to the crystallizer 24.

The process illustrated in FIG. 1 has the advantage of producing quinoline and isoquinoline as a first by-product in stream 17 and solid indole as a second by-product in stream 26. Furthermore, the second raffinate removed in stream 22 will have all of the tar bases removed to insignificant levels, while retaining hydrocarbons such as biphenyl, acenaphthene, and the like, together with methylnaphthalenes, providing a material suitable for solvent applications. If some tar bases or other materials causing color or color formation are still present in stream 22, they may be removed by extraction with concentrated (e.g. 98%) sulfuric acid, as described in commonly assigned co-pending application Ser. No. 288,242, filed July 29, 1981 herewith.

Figure 2:
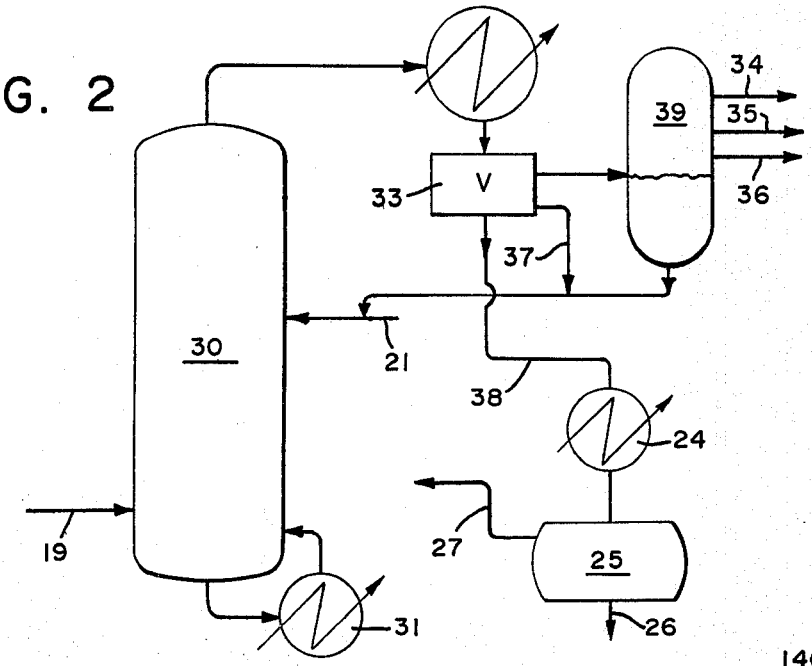

A modification of the process illustrated in FIG. 1 is shown in FIG. 2.

First raffinate in stream 19 is produced in first extraction column as illustrated in FIG. 1. Thereafter, the raffinate is fed in stream 19 to a point near the bottom of distillation collumn 30. Also fed into column 30, either with stream 19 or elsewhere, is a stream of ethylene glycol 21, which acts as an extractive distillation solvent, suppressing vapor formation by indole until hydrocarbons and other materials are removed overhead.

The bottoms from column 30 are recycled through a reboiler 31, preferably with the entire material returned, but optionally with some take off as tars, high boilers and the like. The overheads from column 30 are fed to a condenser 32, and thereafter to a splitter 33, with a portion continuously returned to the top of column 30 as reflux. When operating in batch fashion, as is preferred, splitter 33 produces a series of five overhead fractions removed sequentially.

The first three fractions contain two phases of condensate and are each phase-separated in vessel 39 into an upper hydrocarbon phase and a lower ethylene glycol phase. The upper phases are removed sequentially as a first hydrocarbon phase 34 rich in methylnaphthalenes and enriched in methylnaphthalene, a second hydrocarbon phase 35 rich in methylnaphthalenes and enriched in 1-methylnaphthalene and a third hydrocarbon phase 36 rich in hydrocarbons other than methylnaphthalenes such as biphenyl and acenaphthene.

The fourth fraction 37 is principally ethylene glycol and it, together with the lower phases of the first three fractions, can be returned to column 30 via stream 21. The fifth fraction 38 contains indole with some ethylene glycol. The fifth fraction 38 is chilled in crystallizer 24 to form a slurry of indole in ethylene glycol, and then separated in centrifuge 25 into solid indole, removed in stream 26, and mother liquor, removed in stream 27. As in the case illustrated in FIG. 1, the mother liquor of stream 27 may be distilled or otherwise treated to remove ethylene glycol for recycle to stream 21, with the concentrated indole solution remaining returned to crystallizer 24. Alternatively, stream 27 may be returned to distillation column 30.

The process illustrated in FIG. 2 has certain advantages over that of FIG. 1 in recovering the indole from the first extract. In particular, it is possible to recover methylnaphthalenes in purer form or with an enrichment of one or the other isomer by taking separate overhead fractions to produce hydrocarbon phases 34 and 35. The process of FIG. 2 has the disadvantage, however, of requiring energy consumption for distillation, and therefore, the process illustrated in FIG. 1 is preferred so long as methylnaphthalene with other hydrocarbons, as removed in stream 22, is satisfactory for the application contemplated.

Figure 3:
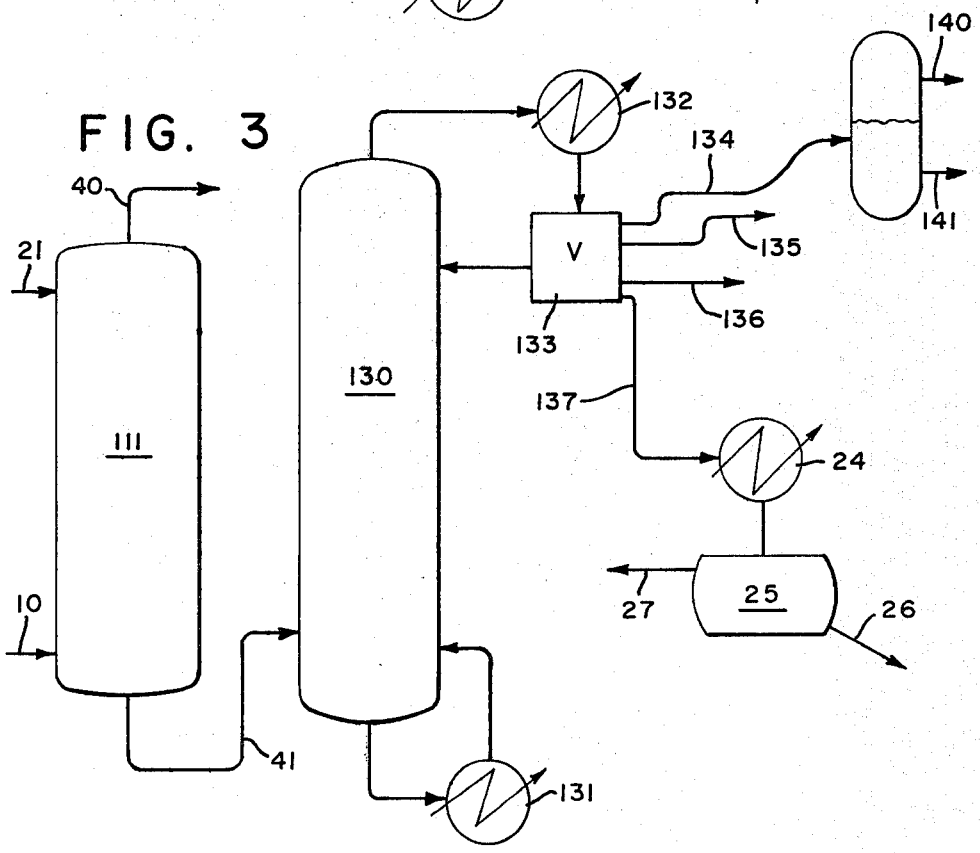

FIG. 3 illustrates the practice of the method of the present invention, which bears some resemblance to the second extractive stage of the process illustrated in FIG. 1.

The same base-extracted tar distillation fraction 10 is fed to the base of extraction column 111. Fed near the top of extraction column 111 is ethylene glycol in stream 21. By countercurrent extraction, a raffinate is produced near the top of the column, and removed as stream 40. Stream 40 contains the methylnaphthalene, biphenyl and other hydrocarbons initially present in stream 10. The extract is removed from the base of column 111 in stream 41 and contains isoquinoline, quinoline and indole, as well as some methylnaphthalenes, dissolved in ethylene glycol. Stream 41 is then fed to the base of a distillation column 130 operated in a manner similar to distillation column 30 in FIG. 2. The bottoms are heated in reboiler 131 and returned to the column, with some bleed or other system optionally used to remove high boilers. The overheads from column 130 are condensed in condenser 132 and fed to a reflux splitter 133 where a portion is continuously returned to the top of column 130 as reflux. Reflux splitter now produces, sequentially over time, four overheads: first overhead 134, second overhead 135, third overhead 136 and fourth overhead 137, which is rich in indole. Quinoline and isoquinoline can normally be recovered together as part of streams 135 or 136 depending upon the timing of overhead separation. In general, such quinoline and isoquinoline will contain some indole as a contaminant. The fourth overhead 137 can be selected, however, to contain indole without significant quinoline or isoquinoline present. Stream 137 is fed to crystallizer 24 where it is cooled to form a slurry, which is separated in centrifuge 25 into indole solids in stream 26 and mother liquor in stream 27. As in the processes described in FIGS. 1 and 2, the mother liquor of stream 27 may be treated to recover ethylene glycol for recycle to stream 21 and a more concentrated indole solution for return to crystallizer 24. Since, in general, first extract 41 will contain some methylnaphthalenes, the overheads, and especially the first overhead 134, is likely to contain both methylnaphthalene and ethylene glycol which have very limited solubilities one in the other. Accordingly, two phases will form, with methylnaphthalene-rich phase 140 removed on top and the ethylene glycol-rich phase 141 removed on the bottom. Depending upon the impurities present therein, each may be recycled to an appropriate place in the process (e.g. by recycling stream 141 to stream 21 and by recycling stream 140 to stream 10).

EXAMPLES

The tar fractions used in following examples were taken from various process streams of tar distillation plants. In general, a distillation cut was taken at the plant of defining boiling point range. The fraction was extracted with sodium hydroxide to remove tar acids and the extract was further distilled to produce naphthalene and a methylnaphthalene-rich fraction, which was the starting material for the present experiments. Because of variations in operating conditions at the tar distillation plants, the materials used in some of the present examples differed as to composition. Aliquots of each sample were analyzed by gas chromatography; and the major components, by weight percentages, are indicated in Table 1.

TABLE 1

| | Starting Materials | | | | |
|---|---|---|---|---|---|
| Material | A | B | C | D | E |
| Naphthalene | 6.3 | 5.6 | 4.9 | 15.8 | 5.0 |
| 2-Methyl naphthalene | 43.7 | 47.1 | 30.4 | 33.4 | 47.2 |
| 1-Methyl naphthalene | 19.8 | 19.8 | 13.1 | 16.7 | 18.8 |
| Quinoline | 10.9 | 12.0 | 11.2 | 7.2 | 9.2 |
| Isoquinoline | 5.1 | 4.4 | 3.5 | 5.8 | 4.5 |
| Biphenyl | 5.6 | 4.7 | 8.7 | 8.0 | 4.7 |
| Indole | 5.3 | 5.2 | 5.3 | 3.8 | 4.8 |
| Dibenzofuran | <1.0 | <1.0 | 5.6 | <1.0 | 1.3 |
| Acenaphthene | <1.0 | <1.0 | 7.4 | 2.4 | 2.1 |
| Indene | 1.0 | <1.0 | <1.0 | <1.0 | <1.0 |
| Benzofuran | <1.0 | <1.0 | <1.0 | <1.0 | <1.0 |
| Lights* | <1.0 | <1.0 | <1.0 | <1.0 | <1.0 |

*material boiling below 170° C.

EXAMPLE 1

Ethylene Glycol Extraction 1500 g of the tar fraction labeled Material A in Table 1 was extracted twice with ethylene glycol, first with 1500 g, then with 1000 g. 2500 g of the combined extracts were then fractionally distilled at atmosphere pressure using a 20-tray, 2 inch (5.1 cm) diameter Oldershaw column, operated in batch fashion with a 10:1 reflux ratio. Overhead samples were collected sequentially as indicated in Table 2 and analyzed by gas chromatography as indicated in Table 2. The first three samples formed a top and bottom phase (e.g. 1T and 1B) each, with the remaining samples being one phase at room temperature. The symbols in Table 2 represent ethylene glycol (EG), naphthalene (N)), 2-methylnaphthalene (2 MN), 1-methylnaphthalene (1 MN), quinoline (Q), isoquinoline (IQ), biphenyl (BP) and indole (I). The head temperature was 176° C. for sample 1, 186° C. for sample 2, 193° C. for sample 3, 196° C. for samples 4–6, 197° C. for samples 7–19 and 198° C. for samples 20–34; the pot temperature was 197° C. for samples 1 and 2, 198° C. for samples 3–11, 199° C. for samples 12–25 and 200° C. for samples 26–34.

TABLE 2

Fractional Distillation of Ethylene Glycol Extract

| Sample | Amt. | EG | N | 2MN | MN | Q | IQ | BP |
|---|---|---|---|---|---|---|---|---|
| 1T | | — | 28.5 | 52.6 | 14.5 | — | — | 6.3 |
| | 71 | | | | | | | |
| 1B | | 90.7 | 2.5 | 4.5 | 1.0 | — | — | — |
| 2T | | — | 5.9 | 64.4 | 25.3 | — | — | 1.2 |
| | 61 | | | | | | | |
| 2B | | 90.6 | 0.9 | 5.5 | 2.1 | — | — | — |
| 3T | | — | 0.4 | 46.1 | 31.2 | — | — | 11.2 |
| | 65 | | | | | | | |
| 3B | | 85.6 | — | 4.5 | 3.1 | 4.4 | 0.8 | — |
| **Sample** | **Amt.** | **EG** | **I** | **2MN** | **1MN** | **Q** | **IQ** | **BP** |
| 4 | 48 | 51.1 | 0.1 | 3.8 | 4.2 | 27.2 | 7.4 | 4.3 |
| 5 | 77 | 60.5 | 0.1 | — | — | 30.4 | 7.2 | 0.3 |
| 6 | 82 | 61.3 | 0.1 | — | — | 29.7 | 7.3 | 0.3 |
| 7 | 82 | 63.4 | 0.2 | — | — | 27.3 | 7.5 | 0.3 |
| 8 | 83 | 65.6 | 0.3 | — | — | 24.3 | 8.0 | 0.3 |
| 9 | 82 | 69.3 | 0.5 | — | — | 20.2 | 8.3 | 0.3 |
| 10 | 68 | 72.1 | 0.7 | — | — | 16.8 | 8.3 | 0.2 |
| 11 | 73 | 74.8 | 0.9 | — | — | 14.6 | 7.9 | 0.2 |
| 12 | 86 | 79.4 | 1.0 | — | — | 10.1 | 7.8 | 0.1 |
| 13 | 82 | 85.5 | 1.2 | — | — | 7.6 | 7.4 | 0.1 |
| 14 | 92 | 85.5 | 1.5 | — | — | 5.1 | 6.6 | — |
| 15 | 84 | 88.0 | 1.7 | — | — | 3.2 | 5.8 | — |
| 16 | 78 | 89.7 | 1.9 | — | — | 2.1 | 5.1 | — |
| 17 | 80 | 87.5 | 2.1 | — | — | 1.2 | 4.1 | — |
| 18 | 40 | 91.0 | 2.3 | — | — | 0.8 | 3.7 | — |
| 19 | 112 | 92.6 | 2.4 | — | — | 0.5 | 3.1 | — |
| 20 | 60 | 93.6 | 2.6 | — | — | 0.2 | 2.4 | — |
| 21 | 101 | 94.2 | 2.7 | — | — | 0.1 | 1.9 | — |
| 22 | 64 | 94.6 | 2.9 | — | — | — | 1.5 | — |
| 23 | 71 | 94.9 | 3.1 | — | — | — | 1.2 | — |
| 24 | 49 | 95.0 | 3.3 | — | — | — | 1.0 | — |
| 25 | 32 | 95.3 | 3.1 | — | — | — | 1.0 | — |
| 26 | 56 | 95.5 | 3.1 | — | — | — | 0.7 | — |
| 27 | 42 | 95.6 | 3.2 | — | — | — | 0.6 | — |
| 28 | 45 | 95.7 | 3.3 | — | — | — | 0.5 | — |
| 29 | 38 | 95.0 | 3.3 | — | — | — | 0.4 | — |
| 30 | 57 | 95.0 | 3.9 | — | — | — | 0.3 | — |
| 31 | 65 | 94.7 | 4.1 | — | — | — | 0.2 | — |
| 32 | 67 | 94.4 | 4.5 | — | — | — | 0.1 | — |
| 33 | 63 | 93.9 | 5.0 | — | — | — | 0.1 | — |
| 34 | 53 | 93.9 | 5.5 | — | — | — | 0.1 | — |
| P.R. | 136 | 58.7 | 37.0 | — | — | — | 1.6 | — |
| S.M. | 2500 | 73.9 | 4.9 | 5.4 | 2.5 | 7.9 | 4.2 | 0.7 |

P.R. = pot residue
S.M. = starting material (combined extract) (also 1.5% napthalene)

It can be seen from these results that proper operation will produce a cut rich in methylnapththalenes (samples 1,2 and 3T) from which tar bases (principally quinoline and isoquinoline) can be extracted if needed to achieve good color. A cut rich in quinoline (samples 3B, 4–12) can be taken next. A cut rich in indole can be taken last: either a broad cut with other tar bases (samples 13-residue) or a narrower cut free of quinoline and low in isoquinoline (samples 22-residue). In either case, indole of high purity can be achieved by recrystallization, e.g. in ethylene glycol as a temperature-dependent solvent for indole.

EXAMPLE 2

Extraction of Tar Fraction With Acidic Aqueous Solutions

A series of samples, each 50 mL, of the tar fraction labeled Material B in Table 1, above, were each extracted with an aqueous acid or acidic salt solution as indicated in Table 3. Each sample had sufficient quinoline and isoquinoline to require about 60 milliequivalents of acid for complete extraction of these materials. In runs, A, C, D, G, H and J, the amount of acid or acidic salt employed was calculated to supply this number of milliequivalents. In runs, B, E, F, K and L, a large (350–900 milliequivalents) excess over this stoichiometric amount was used. In run I, a slight (30%) excess of salt solution was used. The pH of each aqueous solution was taken before extraction, an an aliquot of each raffinate was analyzed by gas chromatography, with the results as displayed in Table 3.

TABLE 3

Salt Extractions of Material B

| | Area % | pH | N | 2MN | 1MN | Q | IQ | BP | I |
|---|---|---|---|---|---|---|---|---|---|
| | Extraction By | | | | | | | | |
| | None | | | | | | | | |
| | (Material B) | — | 6.3 | 43.7 | 19.8 | 10.9 | 5.1 | 5.6 | 5.3 |
| A | 20% $NH_4H_2PO_4$ | 4.1 | 6.3 | 43.9 | 19.9 | 10.7 | 4.8 | 5.7 | 5.4 |
| B | 20% $NH_4H_2PO_4$ + $H_3PO_4$ | 1.1 | 7.2 | 51.0 | 23.2 | — | — | 6.2 | 5.8 |
| C | 20% $KHSO_4$ | 1.1 | 7.3 | 51.1 | 23.3 | — | — | 6.3 | 5.7 |
| D | 20% $NH_4HSO_4$ | 1.1 | 7.3 | 50.0 | 23.0 | — | — | 6.3 | 5.8 |
| E | 20% $NH_4HSO_4$ | 1.1 | 7.3 | 50.5 | 22.9 | — | — | 6.4 | 5.5 |
| F | Dil. $H_2SO_4$ | 1.1 | 7.5 | 52.5 | 23.8 | — | — | 6.4 | 2.9 |
| G | 20% $NH_4HSO_4$ + 20% $(NH_4)_2SO_4$ | 2.0 | 7.2 | 50.8 | 23.1 | — | — | 6.2 | 5.9 |
| H | 20% $NH_4HSO_4$ + 20% $(NH_4)_2SO_4$ | 3.0 | 7.0 | 48.9 | 22.1 | 3.3 | — | 6.2 | 5.8 |
| I | 20% $NH_4HSO_4$ + $H_2SO_4$ | 0.5 | 7.3 | 51.1 | 23.1 | — | — | 6.4 | 5.3 |
| J | Dil $H_2SO_4$ | 0.5 | 7.3 | 50.8 | 23.1 | — | — | 6.3 | 5.7 |
| K | Dil $H_2SO_4$ | 0.5 | 7.6 | 52.8 | 23.9 | — | — | 6.6 | 1.8 |
| L | 20% $NH_4HSO_4$ +$H_2SO_4$ | 0.5 | 7.6 | 53.2 | 24.1 | — | — | 6.6 | 1.1 |

From the results of Table 3, it should be apparent that extractions employing a salt solution with a pH between about 1 and 3 (runs B–E and G) consistently produced extracts with all of the detectable quinoline and isoquinoline removed from the raffinate, but high (5.5–5.9%) levels of indole left in the raffinate. Run A, at a pH of 4.1, failed to remove quinoline or isoquinoline from the extract. Run H, at a pH of 3.0 left some quinoline (3.3%); but since no excess salt solution was used, less preferred modes of the invention will occur at a pH of about 3.0. At a pH of 0.5, some indole was removed with near stoichiometric salt solution (Run I), and more indole was removed with large excesses of salt solution (Run L). Therefore, a pH of about 0.5 represents a practical lower limit, since extra control is required at that pH to achieve complete quinoline and isoquinoline removal without loss of indole from the extract. Runs F, J and K, wherein dilute acid was used instead of the preferred acidic salts required larger volumes of aqueous extractant and, furthermore, indicated a similar tendancy to lose indole from the extract whenever low pH and excess acid was present (Run K).

EXAMPLE 3

Ammonium Bisulfate Extraction Followed by Indole Separation and Quinoline Recovery Ammonium sulfate, water, and 98% sulfuric acid were mixed together to give 12 kg of 30% ammonium bisulfate. This solution was mixed with 17.64 kg of tar fraction labeled material E in Table 1 by pumping the two solutions through Kenics static mixer-settler devices. The feed rate of the tar fraction was 800 mL/min and the bisulfate solution was 475 mL/min. The phases were separated, and analysis of the raffinate indicated essentially complete removal of the quinoline and isoquinoline to <0.5% with only slight indole loss to the extract.

From the aqueous bisulfate phase 12.873 kg was divided into three batches and neutralized by adding ammonia to pH 6.8–7.8 resulting in phase separation as indicated in Table 4. The analysis of the quinoline phase indicates the presence of approximately 2% methylnaphthalenes and 2.5% indole. Not included in the listed analysis was 10% water. Quinoline was separated from this mixture by distillation using a 50 tray Oldershaw column. Various distillation procedures may be used depending on the required product purity. The methylnaphthalene can either be removed as lights or it can be extracted from the aqueous phase before neutralization using another organic solvent such as toluene.

Raffinate from the ammonium bisulfate extraction, consisting primarily of methylnaphthalenes, naphthalene, biphenyl and indole, was processed further by extracting the indole from the methylnaphthalene into ethylene glycol. This countercurrent extraction was done using a York-Scheibel extraction column and feeding ethylene glycol at the top and an approximately equal volume of methyl naphthalene at the bottom. Data in Table 4A show that >80% of the indole is extracted into the glycol and also very little of the methylnaphthalene is in the glycol. Raffinate from this extraction consisted of naphthalene, methylnaphthalenes, and biphenyl with 1–2% indole and <0.1% glycol.

TABLE 4

RECOVERY OF QUINOLINES FROM ACID EXTRACT
FEED - SPENT 30% $NH_4HSO_4$

| | Feed (g) | $NH_3$ (g) | UPPER PHASE (g) | LOWER PHASE (g) | UPPER PHASE ANALYSIS (weight %) 2MN | 1MN | Q | IQ | INH |
|---|---|---|---|---|---|---|---|---|---|
| BATCH 1 | 3724 | 127 | 692 | 3159 | 1.68 | 0.77 | 63.01 | 27.9 | 2.1 |
| BATCH 2 | 4031 | 148 | 741 | 3438 | 1.73 | 0.78 | 63.2 | 26.5 | 2.2 |
| BATCH 3 | 5118 | 365 | 969 | 4514 | 1.20 | 0.55 | 63.7 | 26.7 | 2.5 |
| COMPOSITE | 12873 | | 2402 | | 1.51 | 0.66 | 62.9 | 28.4 | 2.5 |

QUINOLINE PHASE AS PERCENT OF FEED = $\frac{2402}{12873}$ = 18.7%

TABLE 4A

COUNTER CURRENT YORK-SCHEIBEL COLUMN EXTRACTION OF MN WITH EG

| # | TIME, HRS. | FEED RATE mL/MIN MN | EG | TAKE OFF RATE, ML/MIN. | ANALYSIS, % INDOLE MN, IN | MN, OUT | EG, OUT |
|---|---|---|---|---|---|---|---|
| 1 | 0 | 9.2 | 9.5 | 9.5 | 9.9 | — | — |
| 2 | 0.5 | 9.2 | 9.7 | 7.8 | " | 2.7 | 5.1 |
| 3 | 1.0 | 9.5 | 10.0 | 10.3 | " | — | — |
| 4 | 1.5 | 9.8 | 9.7 | 9.7 | " | — | — |
| 5 | 2.0 | 9.3 | 9.7 | 9.8 | " | 1.7 | 6.4 |
| 6 | 2.5 | 9.7 | 9.7 | 9.8 | " | — | — |
| 7 | 3.0 | 9.5 | 9.7 | 9.7 | " | — | — |
| 8 | 3.5 | 9.5 | 9.3 | 11.1 | " | 1.5 | 7.8 |

TABLE 4A—continued

COUNTER CURRENT YORK-SCHEIBEL COLUMN EXTRACTION OF MN WITH EG

| # | TIME, HRS. | FEED RATE mL/MIN MN | EG | TAKE OFF RATE, ML/MIN. | ANALYSIS, % INDOLE MN, IN | MN, OUT | EG, OUT |
|---|---|---|---|---|---|---|---|
| 9 | 4.0 | 9.7 | 9.4 | 11.0 | " | — | — |
| 10* | 0 | 9.8 | 10.5 | 10.6 | " | — | — |
| 11 | 0.5 | 9.8 | 10.3 | 10.3 | " | 2.1 | 5.7 |
| 12 | 1.0 | 9.7 | 10.1 | — | " | — | — |
| 13 | 1.5 | 9.8 | 10.2 | 16.4 | " | — | — |
| 14 | 2.0 | 10.0 | 10.0 | 15.3 | " | — | — |
| 15 | 2.5 | 10.0 | 9.8 | 10.3 | " | — | — |
| 16 | 3.0 | 10.0 | 9.8 | 10.2 | " | — | — |
| 17 | 3.5 | 9.7 | 9.3 | 9.2 | " | — | — |
| 18 | 4.0 | 10.3 | 9.3 | 9.2 | " | — | — |
| 19 | 5.5 | 9.7 | 10.8 | 10.5 | " | 1.2 | 5.8 |

*The run was continued the next day after shut down overnight.
The run was discontinued before equilibrium was attained.
MN feed contained 85% of methylnaphthalene, naphthalene and biphenyl combined.
EG extract contained 2.5% of the above combined.

EXAMPLE 4

Recovery of Indole From Ethylene Glycol Extract by Batch Distillation

A portion of the ethylene glycol extract of Example 3 was processed in order to separate the ethylene glycol and indole by distillation using a 20-tray Oldershaw column with 10:1 reflux ratio. A batch distillation starting with 2087 g of ethylene glycol extract resulted in removal of the ethylene glycol with small amounts of indole as shown in Table 5. After 1931 g of distillate ethylene glycol was removed, the bottoms product was further separated using vacuum (8.65 kPa absolute pressure) with a single stage flash distillation giving first 69 grams (BP 130°–165° C.) with 20% indole and then 48.5 grams (BP 165°–172° C.) with 95.2% indole and leaving 11 grams of residue.

TABLE 5

BATCH FRACTIONATION OF INDOLE - ETHYLENE GLYCOL MIXTURE
(20 TRAY OLDERSHAW COLUMN - REFLUX RATIO 10:1)

| SAMPLE NO. | OVERHEAD TEMP. °C. | DISTILLATE, GM. TOTAL | INCREMENTAL | DISTILLATE ANALYSIS % INDOLE | WT. INDOLE |
|---|---|---|---|---|---|
| 1 | 126.5–187.5 | 61 | 34 | 0.028 | 0.009 |
| 2 | 187.5–197 | 158 | 64 | 0.3 | 0.19 |
| 3 | 197 | 241 | 83 | 0.81 | 0.67 |
| 4 | 197 | 337 | 96 | 0.84 | 0.81 |
| 5 | 197 | 421 | 84 | 0.76 | 0.64 |
| 6 | 197 | 437 | 16 | 0.79 | 0.13 |
| 7 | 197.2 | 539 | 102 | 0.86 | 0.88 |
| 8 | 197.2 | 641 | 102 | 0.9 | 0.92 |
| 9 | 197.5 | 738 | 97 | 0.93 | 0.9 |
| 10 | 197.5 | 841 | 103 | 0.97 | 1.0 |

TABLE 5-continued

BATCH FRACTIONATION OF INDOLE - ETHYLENE GLYCOL MIXTURE (20 TRAY OLDERSHAW COLUMN - REFLUX RATIO 10:1)

| SAMPLE NO. | OVERHEAD TEMP. °C. | DISTILLATE, GM. TOTAL | DISTILLATE, GM. INCREMENTAL | DISTILLATE ANALYSIS % INDOLE | DISTILLATE ANALYSIS WT. INDOLE |
|---|---|---|---|---|---|
| 11 | 197.5 | 959 | 118 | 1.03 | 1.21 |
| 12 | 197.5 | 1038 | 79 | 1.07 | 0.85 |
| 13 | 197.5 | 1154 | 116 | 1.11 | 1.29 |
| 14 | 197.5 | 1234 | 80 | 1.17 | 0.94 |
| 15 | 197.5 | 1350 | 116 | 1.16 | 1.34 |
| 16 | 197.5 | 1465 | 115 | 1.24 | 1.43 |
| 17 | 197.5 | 1550 | 85 | 1.31 | 1.11 |
| 18 | 197.5 | 1666 | 116 | 1.42 | 1.62 |
| 19 | 197.5 | 1779 | 113 | 1.53 | 1.73 |
| 20 | 197.5 | 1890 | 111 | 1.79 | 1.99 |
| 21 | 198 | 1931 | 41 | 1.98 | 0.81 |
| *22 | 130–165 | 2000 | 69 | 20 | 13.8 |
| *23 | 165–172 | 2049 | 48.5 | 95.2 | 46.1 |
| | | POT 11 | | 39.7 | |

*65 mm Hg abs. pressure

EXAMPLE 5

Recovery of Indole From Ethylene Glycol Extract Using Continuous Distillation An additional portion of the ethylene glycol extract of Example 3 was separated into an ethylene glycol phase and an indole-rich phase by continuous distillation in the presence of methylnaphthalene using a 20 tray Oldershaw column with the feed at tray 10 starting with ethylene glycol extract and feeding in some quinoline-free methylnaphthalene. The distillation started batchwise to concentrate the indole, in the bottoms. Once the bottoms composition was high in indole, continuous feed of glycol extract was started along with methylnaphthalene. The overhead product consisted of two phases: methylnaphthalene and ethylene glycol. The methylnaphthalene was separated and recycled with the feed. The reason for recycling the methylnaphthalene is that the resulting two phase distillation minimizes the overheads temperature and therefore decreases the amount of indole in the overheads. The data in Table 6 show overheads glycol phase with less than 1% indole and bottoms with greater than 80% indole.

Bottoms from the above distillation was further distilled under vacuum (8.65 kPa absolute pressure) using a 5 tray Oldershaw column and giving overhead product containing 96–98% indole.

TABLE 6A

| | ANALYSES EG | 2MN | 1MN | BP | IND |
|---|---|---|---|---|---|
| 1O | 88.74 | 4.24 | 2.14 | 0.64 | 0.36 |
| 1B | 1.39 | 0.11 | 0.16 | 2.2 | 84.61 |
| 2O | 90.21 | 4.31 | 2.09 | 0.49 | 0.36 |
| 2B | 1.56 | 0.02 | 0.03 | 1.11 | 86.14 |
| 3O | 84.16 | 4.32 | 2.2 | 0.63 | 1.1 |
| 3B | 1.56 | 0.03 | 0.03 | 1.04 | 87.42 |
| 4O | 86.44 | 4.30 | 2.1 | 0.54 | 1.13 |
| 4B | 2.25 | 0.01 | 0.01 | 0.93 | 89.87 |
| 5O | 86.58 | 4.45 | 2.24 | 0.56 | 0.99 |
| 5B | 2.2 | — | — | 0.73 | 90.75 |
| 6O | 87.27 | 4.10 | 2.11 | 0.56 | 0.87 |
| 6B | 2.12 | 0.12 | 0.07 | 0.67 | 90.63 |
| 7O | 87.57 | 4.57 | 2.2 | 0.37 | 0.34 |
| 7B | 2.93 | 0.11 | 0.16 | 1.69 | 85.25 |
| 8O | 87.87 | 4.65 | 2.21 | 0.23 | 0.46 |
| 8B | 2.87 | 0.25 | 0.38 | 3.05 | 82.93 |

In Table 6A, "10" refers to the overhead (glycol phase) of fraction 1 and 1B to the bottoms of fraction 1, both taken under conditions indicated in the first line of Table 6. The remaining lines are analyses of overhead (glycol phase) and bottoms under conditions of the indicated lines of Table 6.

EXAMPLE 6

Sodium Bisulfate Extraction of Material Followed by Indole Recovery

Sodium sulfate, water, and 98% sulfuric acid were mixed together to give 3000 g of 20% sodium bisulfate. Three kilograms of tar fraction labeled E in Table I were mixed with three kilograms of the 20% sodium bisulfate solution in a jacketed agitated reactor for 1 hour. After settling for ½ hour the phases were separated. The methylnaphthalene phase was analyzed and found to be free of quinolines.

From the above raffinate (methylnaphthalene phase) 1884 gm was added to a 5 L flask along with 1884 g of ethylene glycol. The components were distilled from this mixture using a 20 tray Oldershaw column and 10:1 reflux ratio. Table 7 shows conditions of the distillation; Table 7A shows analysis of the products with sample numbers in Table 7A corresponding to conditions in Table 7. A two-phase overhead was produced consisting of 90% glycol as one phase and a second phase, initially naphthalene, then a high concentration of methylnaphthalenes (as high as 96%) and then increasing concentrations of biphenyl. Once the biphenyl removal was completed, the second phase disappeared and only glycol phase came overhead. Data in Table 8 show the completion of this distillation using a 10 tray Oldershaw column of 10:1 reflux and at 8.6 kPa absolute pressure,

TABLE 6

CONTINUOUS DISTILLATION OF ETHYLENE GLYCOL FROM ETHYLENE GLYCOL EXTRACT OF QUINOLINE-FREE MN USING PARTIAL RECYCLE OF METHYL NAPHTHALENE (MN)

| Fraction | REFLUX RATIO | BOTTOMS* TEMP. (°C.) | EG FEED (mL/min) | MN FEED (mL/min) | EG OVHD. / EG feed | MN OVHD. / MN feed |
|---|---|---|---|---|---|---|
| 1 | 4 | 236 | 1.25 | 0.77 | 0.92 | 1.2 |
| 2 | 4 | 233 | 1.25 | 0.77 | 0.94 | 1.3 |
| 3 | 4 | 232 | 1.28 | 0.79 | 0.88 | 1.18 |
| 4 | 4 | 243 | 1.25 | 0.82 | 0.92 | 1.18 |
| 5 | 5 | 239 | 1.0 | 0.78 | 0.97 | 1.09 |
| 6 | 5 | 241 | 1.0 | 0.8 | 0.97 | 1.09 |
| 7 | 5.5 | 232.5 | 1.0 | 0.8 | 0.9 | 1.0 |
| 8 | 5.5 | 235 | 1.0 | 0.8 | 0.93 | 1.03 |

*The overheads temperature was at 188–189° C. throughout the eight fractions.

wherein indole in concentration as high as 97.5% is recovered.

TABLE 7

ETHYLENE GLYCOL DISTILLATION SEPARATION OF METHYLNAPHTHALENES FROM INDOLE

| | | DISTILLATE | |
|---|---|---|---|
| Sample No. | Overhead Temp °C. | Wt. (g) Sample | Wt. (g) Total |
| 8 | 187 | 23 | 200.5 |
| 10 | 187.5 | 112.5 | 334.5 |
| 12 | 188.5 | 104.5 | 544 |
| 14 | 188.5 | 107.5 | 756.5 |
| 16 | 189 | 106 | 940 |
| 18 | 189 | 108 | 1186 |
| 19 | 189 | 107 | 1293 |
| 20 | 189 | 105 | 1398 |
| 21 | 189.5 | 89 | 1487 |
| 22 | 189.5 | 40 | 1527 |
| 23 | 190 | 39 | 1566 |
| 24 | 191 | 39 | 1605 |
| 25 | 192 | 35.5 | 1640.5 |
| 26 | 192.5 | 36.5 | 1677 |

TABLE 7A

| | ANALYSES | | | | | | | | |
|---|---|---|---|---|---|---|---|---|---|
| | ORGANIC (wt %) | | | | | GLYCOL (wt %) | | | |
| Sample | 2MN | 1MN | Unknowns | BP | IND | gly-col. | 2MN | 1MN | BP |
| 8 | 64.58 | 8.19 | | | 0.03 | | | | |
| 10 | 80.58 | 11.75 | | 0.03 | 0.02 | 90.64 | 6.42 | 1.08 | |
| 12 | 81.86 | 13.57 | | 0.13 | 0.01 | 90.7 | 7.4 | 1.47 | |
| 14 | 79.7 | 16.58 | | 0.17 | 0.02 | 90.27 | 7.35 | 1.81 | |
| 16 | 75.98 | 20.63 | | 0.25 | 0.02 | 88.61 | 8.39 | 2.61 | 0.01 |
| 18 | 65.54 | 27.91 | | 0.32 | 0.03 | 91.11 | 5.81 | 2.62 | 0.02 |
| 19 | 62.34 | 35.88 | | 0.44 | 0.02 | 87.78 | 7.38 | 4.36 | 0.04 |
| 20 | 52.87 | 42.54 | | 0.67 | 0.01 | 90.76 | 4.73 | 3.99 | 0.05 |
| 21 | 39.48 | 54.19 | | 1.12 | 0.01 | 91.58 | 3.26 | 4.49 | 0.08 |
| 22 | 25.55 | 65.09 | | 2.52 | 0.01 | | | | |
| 23 | 14.36 | 70.08 | | 5.86 | 0.02 | | | | |
| 24 | 6.05 | 61.55 | 12.1 | 17.48 | 0.02 | 90.03 | 0.62 | 6.5 | 1.56 |
| 25 | 1.25 | 23.58 | 20.2 | 51.01 | 0.03 | 90.9 | 0.1 | 2.5 | 4.29 |
| 26 | 0.26 | 2.6 | 20.1 | 74.34 | 0.04 | 86.6 | 0.001 | 0.4 | 9.0 |

*Two unknowns split 6.1–6.0 in Sample 24, 4.0–16.2 in Sample 25 and 0–20.1 in Sample 26.

TABLE 8

RECOVERY OF INDOLE FROM GLYCOL DISTILLATION

| Sample No. | POT (°C.) | OVHD (°C.) | Sample Wt. (g) | Analysis (wt %) Glycol | Indole |
|---|---|---|---|---|---|
| 30 | 151–180 | 128–131 | 42 | 68.6 | 22.9 |
| 31 | 180–182 | 131–163.5 | 17 | 9.0 | 68.0 |
| 32 | 182–185 | 163.5–166 | 6 | 1 | 89.1 |
| 33 | 185–190 | 166–167 | 19 | 0.20 | 92.4 |
| 34 | 190–209 | 167 | 21 | 0.13 | 97.5 |
| 35 | 209–284 | 166 | 16 | | 96.3 |
| 36 | 284–360+ | 166 | 12 | | 78.48 |

What is claimed is:

1. A process for the recovery of tar bases from a base-extracted tar distillation fraction which comprises the steps:

(a) extracting a base-extracted tar distillation fraction having a boiling point range not exceeding about 300° C.; containing methylphthalenes, indole and a member selected from the group consisting quinoline, isoquinoline and mixtures thereof with a buffered aqueous salt solution having a pH between about 0.5 and about 3.0 to produce an aqueous extract containing quinoline, isoquinoline or both and raffinate containing methylnaphthalenes and indole and substantially free of quinoline and isoquinoline, (b) recovering indole from said raffinate, and (c) recovering quinoline, isoquinoline or mixtures thereof from said aqueous extract.

2. The process of claim 1 wherein said buffered aqueous salt solution is a solution of a bisulfate of ammonium or an alkali metal, or a mixture thereof with the corresponding sulfate or sulfuric acid having a pH in the above range.

3. The process of claim 2 wherein said bisulfate is ammonium bisulfate, or mixtures thereof with ammonium sulfate or sulfuric acid.

4. The process of claim 3 wherein step (c) includes neutralizing said aqueous extract with ammonia to recover said quinoline, isoquinoline or mixtures thereof as an organic layer.

5. The process of claim 2 wherein said bisulfate is sodium bisulfate, or mixtures thereof with sodium sulfate or sulfuric acid.

6. The process of claim 5 wherein step (c) includes neutralizing said aqueous extract with sodium hydroxide to recover said quinoline, isoquinoline or mixtures thereof as an organic layer.

7. The process of claim 1 wherein indole is recovered from said raffinate by extraction with phosphoric acid and subsequent neutralization of the extract with a base.

8. The process of claim 1 wherein indole is recovered from said raffinate by extraction with a polyhydric alcohol and separation of the extract into indole and polyhydric alcohol.

9. The process of claim 8 wherein said polyhydric alcohol is ethylene glycol.

10. The process of claim 8 or 9 wherein indole is separated from said polyhydric alcohol by distillation.

11. The process of claim 8 or 9 wherein indole is separated from said polyhydric alcohol by crystallization.

12. The process of claim 1 wherein indole is recovered from said extract by extractive distillation in the presence of ethylene glycol to produce a first overhead comprising methylnaphthalenes and a second overhead comprising indole and ethylene glycol, and indole is crystallized from said second overhead.

13. The process of claim 12 wherein said base-extracted tar distillation fraction further comprises additional components selected from the group consisting of biphenyl, acenaphthene, dibenzofuran and mixtures thereof, and wherein said additional components are recovered during extractive distillation with ethylene glycol as overheads between said first overhead and said second overhead.

14. The process of claim 12 wherein said base-extracted tar distillation fraction contains 1-methylnaphthalene and 2-methylnaphthalene in a first proportion, and wherein said first overhead includes an initially recovered portion richer in 2-methylnaphthalene than said first proportion and a subsequently recovered fraction richer in 1-methylnaphthalene than said proportion.

15. A method of separating a mixture comprising methylnaphthalenes and indole which comprises extracting said mixture having a boiling point range not exceeding about 300° C.; with ethylene glycol and recovering a raffinate comprising methylnaphthalenes and an extract comprising indole and ethylene glycol, and recovering indole from said extract.

16. The method of claim 15 wherein said mixture further comprises quinoline, isoquinoline, biphenyl and acenaphthene; wherein biphenyl and acenaphthene are present predominantly in said raffinate; and wherein quinoline and isoquinoline are present in said extract.

17. The method of claim 16 wherein methylnaphthalene is distilled from said raffinate.

18. The method of claim 16 or 17 wherein the extract is distilled to produce a quinoline, isoquinoline, ethylene glycol mixture as a first overhead, ethylene glycol as a second overhead and indole with minor amounts of ethylene glycol as a third overhead, and indole is crystallized from said third overhead.

* * * * *